US007569002B2

(12) United States Patent
Nativ

(10) Patent No.: US 7,569,002 B2
(45) Date of Patent: Aug. 4, 2009

(54) EXERCISE WHEELCHAIR

(76) Inventor: Avinoam Nativ, 3428 Baskins Beach Road, R. R. #1, Dunrobin, Ontario (CA) K0A 1T0

( * ) Notice: Subject to any disclaimer, the term of this patent is extended or adjusted under 35 U.S.C. 154(b) by 294 days.

(21) Appl. No.: 11/273,272

(22) Filed: Nov. 14, 2005

(65) Prior Publication Data

US 2007/0111861 A1 May 17, 2007

(51) Int. Cl.
*A63B 21/00* (2006.01)
*A47C 1/12* (2006.01)

(52) U.S. Cl. ..... 482/92; 297/325

(58) Field of Classification Search ..... None
See application file for complete search history.

(56) References Cited

U.S. PATENT DOCUMENTS

| | | | | |
|---|---|---|---|---|
| 2,512,353 | A | 6/1950 | Magalding et al. | |
| 3,767,190 | A | 10/1973 | Biggerstaff | |
| 3,947,069 | A | 3/1976 | Lusch | |
| 3,964,786 | A * | 6/1976 | Mashuda | 297/330 |
| 4,125,269 | A | 11/1978 | Kiel | |
| 4,324,414 | A | 4/1982 | Wilkes | |
| 4,504,090 | A | 3/1985 | Goldman | |
| 4,607,883 | A | 8/1986 | Tzu-Chun | |
| 4,765,614 | A | 8/1988 | Shute | |
| 4,869,494 | A | 9/1989 | Lambert, Sr. | |
| 4,877,291 | A | 10/1989 | Taylor | |
| 4,984,846 | A | 1/1991 | Ekornes | |
| 5,005,905 | A * | 4/1991 | Sondergedl | 297/320 |
| 5,102,195 | A | 4/1992 | Axelson et al. | |
| 5,110,121 | A | 5/1992 | Foster | |
| 5,209,549 | A | 5/1993 | Chang | |
| 5,472,261 | A | 12/1995 | Oplenskdal et al. | |
| 5,580,340 | A * | 12/1996 | Yu | 482/96 |
| 6,048,292 | A * | 4/2000 | Gasquez | 482/130 |
| 6,106,440 | A | 8/2000 | Olbrish, Jr. | |
| 6,213,923 | B1 | 4/2001 | Cameron et al. | |
| 6,460,928 | B2 * | 10/2002 | Knoblock et al. | 297/300.2 |
| 2006/0181051 | A1 * | 8/2006 | Moller | 280/250.1 |

* cited by examiner

*Primary Examiner*—Fenn C Mathew
(74) *Attorney, Agent, or Firm*—Louis B. Allard; Borden Ladner Gervais LLP

(57) ABSTRACT

A wheelchair is provided with an exercise mechanism which allows the user to perform exercises as desired. The user is able to exercise by extending his or her torso either independently of his legs or combined with exercising his legs. Resistance mechanisms are included to permit users to control the level of difficulty.

17 Claims, 4 Drawing Sheets

EXERCISE WHEELCHAIR

FIELD OF INVENTION

This invention relates to a device which allows a person temporarily or permanently confined to a wheelchair to exercise various parts of their body.

BACKGROUND TO THE INVENTION

Persons who have been confined to a wheelchair whether through injury or through a condition which has affected them since birth typically spend long periods of inactivity time that could be spent exercising. Exercise would improve their strength and function and prevent the muscles that are not often used from atrophying. However, due to weakness and reduced mobility, transfers to exercise machines can be functionally difficult and often impossible without the assistance of others.

Two specific muscle groups that are difficult for a wheelchair-bound patient to exercise are the abdominal and back extensor muscle groups. It is important that a patient perform trunk flexion-extension movements on a regular basis in order to prevent the muscles from atrophying due to disuse. As it is impossible to perform these movements in a regular wheelchair, it is difficult for someone that has a very limited use of their legs and possibly their arms to exercise these very important muscle groups. A need exists, therefore, for a device which allows a person confined to a wheelchair to exercise their abdominal and back extensor muscles.

While chairs and wheelchairs having a reclining feature do exist, none of the chairs are provided with the structure of the invention for the purpose of exercising a patient's torso. A need exists, accordingly, for a device which would permit a wheelchair user to perform the required flexion-extension movements, while providing a safe, stable environment for the user. Such device should preferably provide a variable resistance to the motion to allow for users of different ability.

In the prior art, U.S. Pat. No. 4,125,269 depicts a wheelchair with a provision for the seat to rock. The seat is supported by a pair of trapezoidal linkages that allow the seat to displace forwardly and rearward. However, there is no synchronization with the back portion during this motion. Further, there is no separate resistance attached to either the flexion or extension movement.

U.S. Pat. No. 6,213,923, while not relating to a wheelchair, depicts an exercising reclining device with seat and back portions that are interlinked. The front portion of the seat both slides and rotates about a pivoting axis positioned centrally across the seat and lying directly adjacent to the underside surface of the seat. The rearward portion of the seat is pivotally linked to an extended bottom edge of the back. The back is said in the description to rotate about a shaft connected to the frame. According to the drawings, this action may occur through both a rotational and sliding hinged connection to the frame. According to the drawings, as the back reclines, the point of rotation of the back shifts downwardly. An extension from the back portion protruding below its hinged support is flexibly connected to the rear edge of the seat. A "decline control mechanism 22" is connected between the frame and the joint existing between the seat and back portions, providing either resilience or resistance to deflection (herein after a "resistance" means) within the mechanism. As the back reclines, the seat both rotates and shifts forwardly on its sliding pivot axis, sliding on its supports.

Similarly to U.S. Pat. No. 6,213,923, a reclining chair is depicted in U.S. Pat. No. 3,767,190 wherein the central portion of the seat rotates about a sliding pivot point mounted within a slot on a portion of the folding frame. The rearward portion of the seat is pivotally linked to the bottom edge of the back. The back rotates about its own, hinged connection to the frame at a location which is above the bottom edge of the back. A spring is connected between the frame and a joint connecting the seat and back portions to resist a reclining action. As the back portion reclines, the seat portion is slid and tipped forwardly, while an extension to the seat portion may protrude to underlie a user's thighs.

In U.S. Pat. Nos. 4,504,090; 5,209,549; 4,877,291; 3,947,069 and 2,512,353 each respecting a chair, but not a wheelchair, these references all provide back and seat portions which are connected so that the seat projects forwardly when the back reclines. A specific mechanism is provided to achieve this effect in each case.

In respect of U.S. Pat. No. 4,877,291 the front edge of the seat of a chair, but not a wheelchair, is supported by a swinging link which extends upwardly from the forward region of the seat to a portion of the chair frame while the reclining back pivots about a hinge point fixed to the frame. When the back reclines this seat portion advances, rising slightly along its forward edge as the swinging link departs further from a vertical alignment. A resistance mechanism is coupled between the frame and an extension to the bottom end of the back portion so as to resist the motion of the seat and back portion when the back reclines.

In U.S. Pat. No. 4,607,883 to a chair, but not a wheelchair, the reclining back pivots about a hinge point fixed to the frame. The rear edge of the seat is connected to an extension of the back protruding below the hinged support for the back so that as the seat projects forward, the back reclines. The front edge of the seat is in this case supported by rigid strut, which extends downwardly from the sides of the seat to a portion of the chair frame. The connection between this strut and the chair frame itself includes a pivoting joint connected to a sliding joint which is fitted to the frame through a kind of sliding shoe. This is said to render smoothness to the reclining action. However, as the frame portion that supports the sliding shoe is significantly inclined upwardly, forward advancement of the chair seat has a tendency to elevate the front portion of the seat. Further, this is another example of providing support for the seat through a sliding joint.

It would be desirable to provide a wheelchair adapted to provide exercise wherein all or substantially most of the resistance experienced by the user is provided through an external component not connected with the support for the seat and back.

In the foregoing references the frame for supporting the seat and back portions have been resting directly on the floor through legs or equivalent supports. In the case of a wheelchair this support is provided through wheels, and largely through the principal, large diameter wheels characteristic of most wheelchairs. While such wheels may be locked, there is always present in the case of a wheelchair the risk that a user may shift their centre of gravity backwards to a point rearwardly of the support provided by the large wheels, causing the wheelchair to tip backwards. Many wheelchairs include safety stops to accommodate this event. However, it is still undesirable for any rearward tipping to occur in a wheelchair while the user is exercising his abdominal muscles. In the design of any wheelchair wherein a user may shift his centre of gravity, it is important to minimize the risk that any rearward tipping will occur. As well as providing for an exercise mechanism, the following invention addresses that objective.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The wheelchair of the invention allows a user not only to recline his or her back, but also to extend his or her buttocks forward, and then reverse this motion. Further embodiments of the invention also allow the user to exercise his or her legs either separately from or simultaneously with his or her torso muscle groups. Thus another embodiment allows the user to perform a combined leg-trunk extension movement in order to exercise specific muscle groups that separate leg-extension and trunk flexion movements do not provide.

According to one aspect of the invention, a mobile frame is provided to which at least two rear wheels and at least one front wheel, as well as a seating assembly are attached. The seating assembly comprises a horizontal seat section and a vertical back section, which are each connected to the frame and to each other. The underside of the front portion of the horizontal seat section is pivotably attached to the frame through one or more links mounted between the frame and seat with hinged joints at each end of the respective links. If more than one link is provided, the links are preferably laterally disposed. The hinged joint at the bottom of each link is anchored on the frame. The hinged joint at the upper end of each link, where the link is coupled to the underside of the forward end of the seat, is a first floating hinged joint.

This arrangement provides support for the seat about a pivot point located below the seat. Horizontal displacement of the seat causes it to travel along the top portion of a circular curve or arc.

With the horizontal seat section in its rearward position, the forward links are in nearly vertical alignment, preferably being slightly rearwardly inclined about the hinge joint at the bottom of each link. With the seat in its forward position, the pair of links are still nearly vertically aligned, preferably being slightly forwardly inclined from the vertical about the hinge joint at the bottom of each link. Consequently, in the preferred variant, the first floating hinged joints are able to swing through the upper portion of an arc above or inside the frame, being limited in their travel to a relatively horizontal travel path with only a slight rise or fall occurring throughout that path. This path of travel for the first floating hinged joint is not limited to the configuration as described, but may follow alternate paths.

The vertical back section is connected to the frame through a fixed hinge joint about which the upper portion of the vertical back section may rotate rearwardly. This permits the back section to recline while supported by the frame. A small portion of the back section, or an extension member extending from the back section and serving as the lower end of the back section, extends below the fixed hinge joint as a bottom extension to the back section.

The rearward end portion of the seating section is pivotably connected to the lower end of the back section or to an extending frame member if present. This rear pivoting connection may be made directly to the vertical back section or indirectly through the extending frame member. But in either case it is made through the use of a second floating hinge mounted on the rear of the horizontal seat section. Optionally, the extending frame member from the back may couple centrally to the seat in a notched recess formed along the rear edge of the seat. This allows the horizontal and vertical seat and back sections to change their relative orientation to each other while remaining connected.

As a result of the manner in which the horizontal and vertical seat and back sections are connected both to each other and to the frame, it is impossible for the vertical seat section to recline without also causing the horizontal seat section to move forward and vice versa. It is important that the horizontal seat section move forwards in order to assist in keeping the centre of gravity of the device forward of the contact point where the two rear wheels rest on the ground in order to maintain the stability of the device and to ensure the safety of the user.

Through the use of pivoting joints, sliding friction is avoided. While some rotational joint friction may arise, such friction can be minimized through the use of low friction rotational bearings.

In order to exercise the torso the user leans backwards in his or her seat-, while thrusting forward with their buttocks. This causes the vertical seat section to recline. At the same time, the horizontal seat section shifts forwardly, largely maintaining its orientation with respect to a horizontal plane. Some resistance to this shifting of position, in the absence of other restraints, is associated with the tendency for the centre of gravity of the user and shifting chair portions to become elevated. A more dominant resistance means, preferably a resilient means such as a spring or bungee elastic band is preferably connected to resist such reclining motion. Alternately or additionally, a frictional drag effect can be added by including a damper means in substitution for or in parallel with the resilient means. This can be in the form of a hydraulic cylinder that acts as a dashpot. A fixed connection means such as a length of chain may further be provided in order to prevent the user from hyper-extending the chair by over-rotating the vertical back section.

To provide greater control over the exercising of flexion-extension movements a variable resistance means such as an adjustable hydraulic damping cylinder may be provided. This adjustable damper may be attached to the frame of the chair at one end, and the other end of the piston may be attached to either the seat or back sections in order to provide a resistance to the reclining movement of the seat back. By using a damping device with a degree of damping that is adjustable, the amount of force required in order to recline the chair can be varied according to the capabilities of the user.

When a resilient resistance means is provided such as an elastic cord, the level of resistance may be varied by changing the number of resilient means or by substituting a resilient resistance means which is more or less resilient than the original resistance means. This allows accounting for the variability of trunk strength and combinations of flexion/extension relative strength of different users.

While the damping means is described as extending between the frame and the seat section, it may also extend equally between the frame and the back section and even between the seat and back sections.

alternate, preferred embodiment of the invention includes a leg-exercising device wherein a foot platform is linked to the seat. This platform is hinged to rotate forwardly and away from the seat for use, optionally in conjunction with forward displacement of the seat. A resisting, preferably resilient means as above may be included in the connection between the footrest and the seat. The user may then, as desired, push against the footrest to simply exercise his or her leg muscles. Thus leg exercise may be effected without reclining the vertical seat section.

To prevent the chair from reclining at unwanted times a latch is preferably installed which locks the seat into a preferred travel or rest position.

Optionally, but preferably the footrest may be coupled to assist in the exercising of the torso by allowing the user's leg muscles to contribute towards the effort of advancing the seat and reclining the vertical back section. To achieve this a higher level of coupling may be made through the footrest resistance means, such as a variable resistance damper or a resilient resistance means, e.g. elastic cords such as a bungee cord, that connects the footrest and the seat section.

Dual independent footrests may be provided wherein they are each individually provided with a separate coupling means in a manner that allows them to be individually actuated in order to exercise a single leg, or they may be connected to each other in order to perform a joint, two leg exercise.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
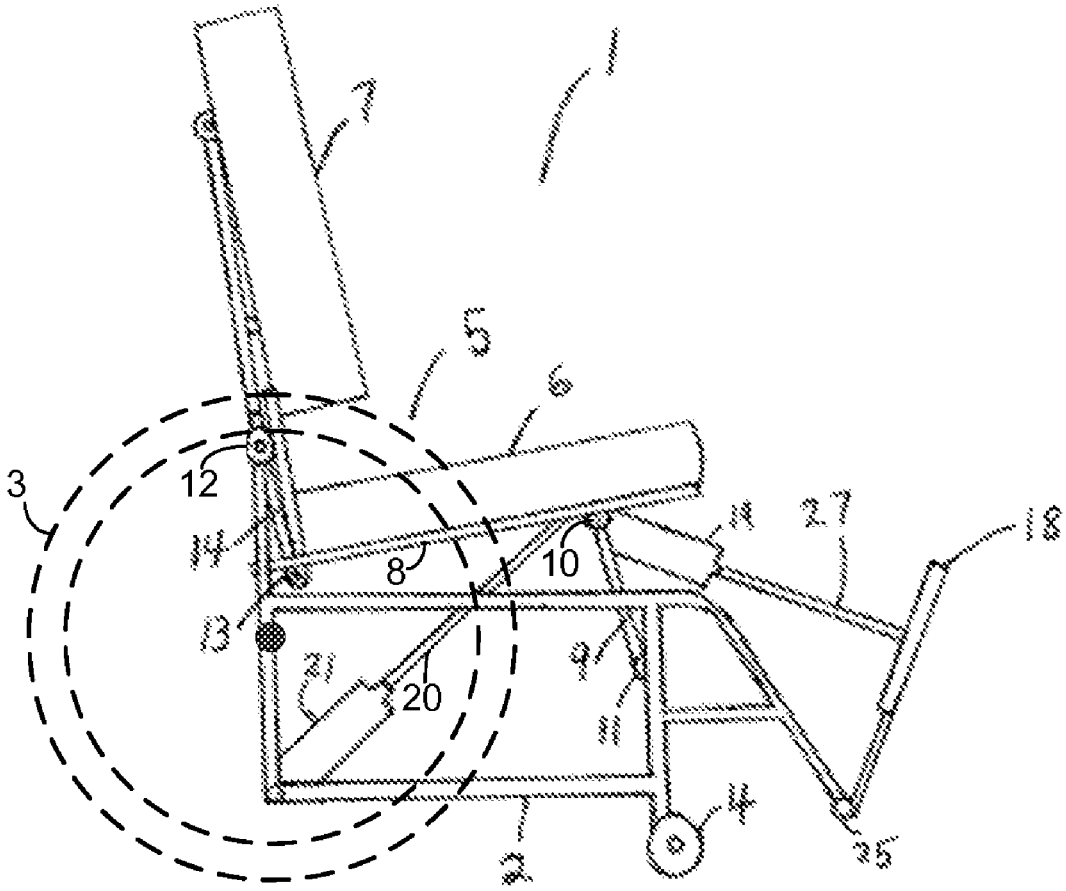
FIG. 1 is a schematic side view of the wheelchair with the seat in the upright position.

In FIG. 1 wheelchair 1 is depicted in an upright orientation. A mobile frame 2 is provided to which two rear wheels 3 and two front wheels 4. A seating assembly 5 is attached to the frame 2 as well. The seating assembly 5 comprises a horizontal seat section 6 and a vertical back section 7 which are each connected to the frame 2 and to each other.

The underside 8 of the front end of the horizontal seat section 6 is provided with an upper, first floating hinge 10 to which is connected a pair of links 9. These links 9 are each connected at their other end through a lower hinge 11 to the frame 2. Both links 9 remain in a generally vertical orientation throughout their range of motion. This allows the horizontal seat section 6, particularly at its front edge portion, to pivot about the frame 2 while the first floating hinge 10 maintains a generally, though not perfectly, horizontal travel path.

The vertical back section 7 is connected to the frame 2 through the use of a back support hinge 12 which pivotably connects a portion of the frame 2 to the lower part of the back section 7 at a point removed from the very bottom end of the back section 7 with extension 14, if present. The back section 7 is able to rotate around this back support hinge 12 and recline.

Figure 2:
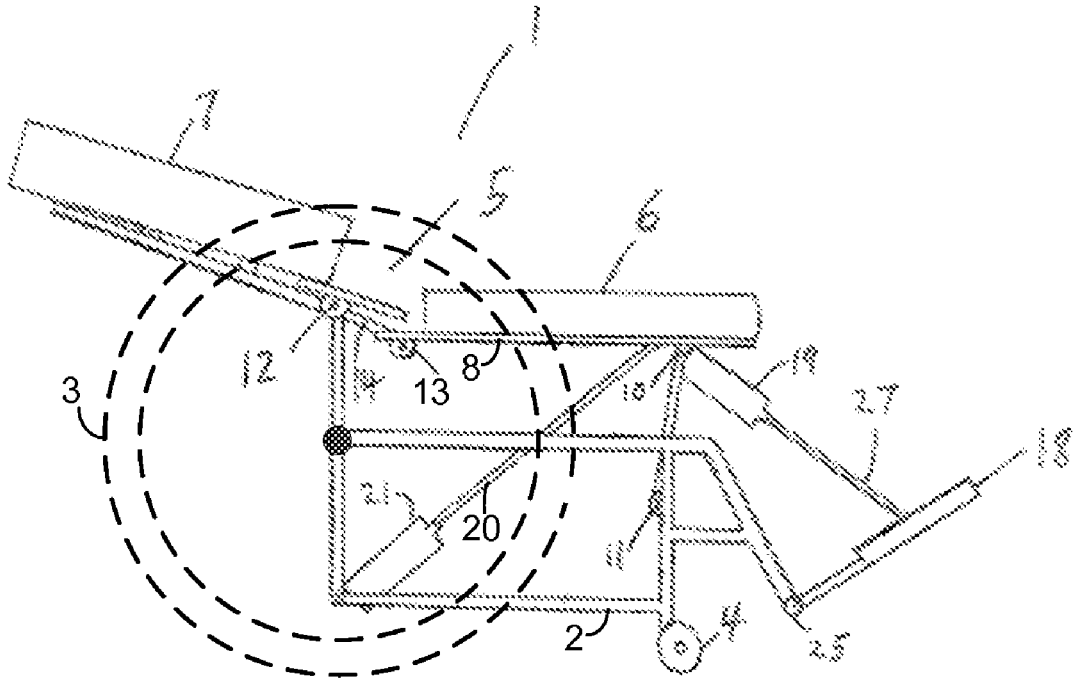
FIG. 2 is a schematic side view of the wheelchair in the reclined position.

The rear of the horizontal seat section 6 is connected directly to the bottom of an extension 14 to the vertical back section 7 through a second floating hinge 13. This hinge 13 is affixed to the rearward portion of the underside 8 of the seat section 6. The hinge 13 connection, however made, allows the vertical back 7 and horizontal seat 6 sections to change their relative orientation to each other while remaining connected. Because of the manner in which these connections are made, the horizontal seat section 6 moves forwards when the vertical seat section 7 reclines, as seen in FIG. 2.

Figure 3:
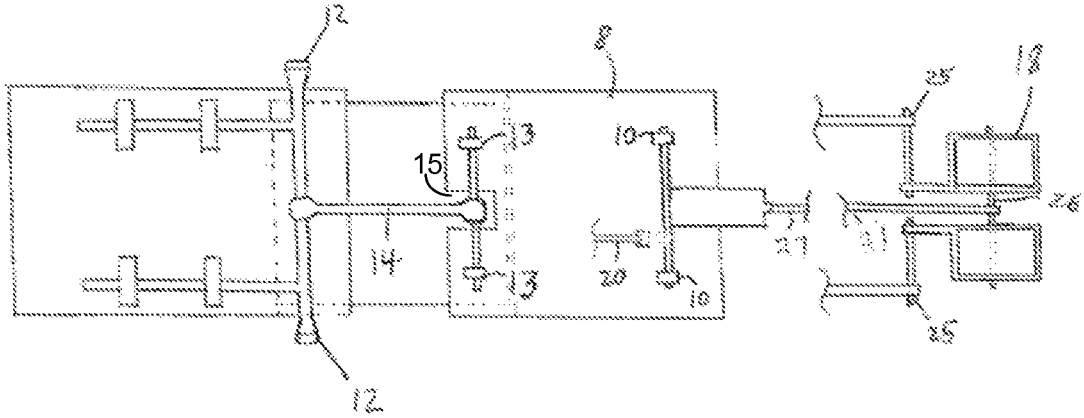
FIG. 3 is a bottom view of the back and seat portions of the wheelchair when in reclined orientation, showing a portion of the frame and the resistance means.

The seat section 6 may include, as shown at FIG. 3, a notch 15 along its lower edge to allow extension. Alternately, the hinge may be moved back to the edge of the underside 8 of the seat 6 and the notch omitted.

As a result of the manner in which the seating assembly sections 6 and 7 are connected both to each other and to the frame 2, it is impossible for the vertical seat section 7 to recline without also causing the horizontal seat section 6 to move forward. Because the rotating joints 10, 13 are mounted such that each joint does not move relative to it's own seat section, and because of the preferred orientation of link 9, the horizontal seat section 6 maintains a relatively horizontal orientation while being displaced forwardly and rearwardly while the vertical seat section 7 rotates around the hinge 12.

It is helpful that the horizontal seat section 6 move forwards when the back section 7 reclines in order to contribute to keeping the centre of gravity of the device 1 substantially within the frame structure 2 and thereby maintain the stability of the device 1, ensuring the safety of the user. Particularly, this centre of gravity should be forward of the contact point of the wheels 3 with the floor.

In one embodiment, the new wheelchair design of the invention is effective in exercising the torso of the user. The user is able to lean backwards in his or her seat 5 causing the back section 7 to rotate about the hinge 12 and causing the horizontal seat section 6 to move forwards with respect to the frame 2. It is preferable to increase the difficulty of the flexion-extension movement by providing a resistance in the form of an elastic cord or a variable resistance damping cylinder 21 which may have a spring bias built into it or provided collaterally. Such a variable-resistance cylinder 21, is attached at one end to the frame 2 of the chair 1 and at the other end, to the underside of the seat 8 in order to provide a resistance to the reclining movement of the seating section 5. Through the use of a variable resistance cylinder 21, a user can vary the amount of force required in order to recline the seating section 5 simply by manually adjusting the resistance of the cylinder 21 and varying the rate at which they attempt to move the mechanism through its range of motions.

Figure 4:
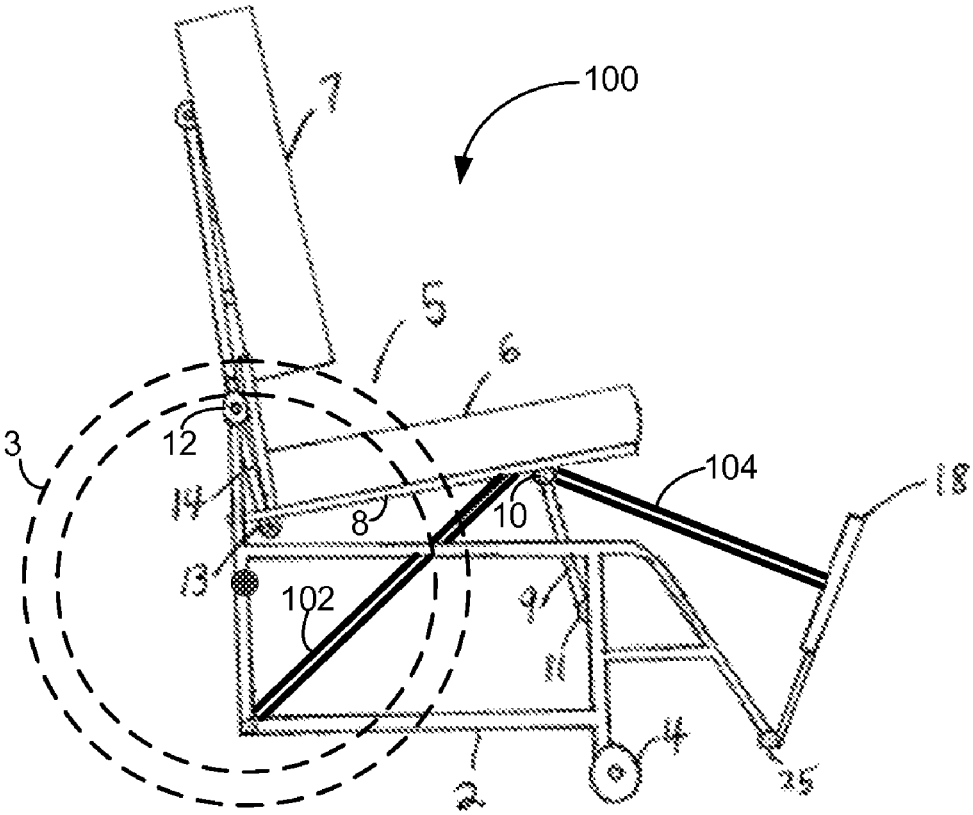
FIG. 4 is a schematic side view of the wheelchair with elastic straps means coupling the seat to the frame and elastic straps coupling the footrest to the seat.

As an alternative to an adjustable cylinder 21, multiple replaceable elastic straps may be substituted to obtain part of the benefits of the cylinder 21. FIG. 4 shows such elastic straps 102.

In a further embodiment of the invention, a footrest 18 may preferably be added. According to one variant, the footrest 18 extends across the width of the wheelchair 1, forwardly of and below the seat section 6. Although a unitary footrest is described, this footrest 18 may be divided into two parts to provide two independent footrests. The footrest 18 is supported by the frame 2 through a supporting hinge 25 and normally has an upward orientation. Pressure on the footrest 18 will cause it to rotate about the hinge 25, which connects the footrest 18 to the frame 2. A foot rest damping cylinder 19 is attached to the underside of the seat 8 near the front end, and the piston end 27 of this footrest damping cylinder 19 is attached to the footrest 18 at a bar 26.

The user may, at any point, optionally include his or her legs in exercising by pushing against the footrest 18. This exercise preferably occurs in conjunction with forcing the back section 7 to recline. The positioning and hinging of the footrest 18 preferably permits the user to be fully stretched-out with his/her legs straight and aligned with the body when the back is fully reclined.

As an alternate to cylinder 19, multiple replaceable elastic straps may be substituted to obtain part of the benefits provided by cylinder 19. FIG. 4 shows such elastic straps 104.

If the damping control on the second cylinder 19 is set to a high level or if multiple, stiff, straps are employed, pressure on the footrest 18 will assist in effecting forward advancement of the seat section 6. The user is thus able to transfer to his leg muscles some of the effort required to recline the back section 7. Alternately, with the damping coefficient of the damping cylinder 19 set at a low level, while avoiding the tendency for the back section 7 to decline, the user can exercise only his legs without reclining in the back section 7. The back section 7 may optionally in such circumstances be provided with a locking mechanism (not shown) to fix it in position and enable training of the legs in isolation.

If the footrest damping cylinder 19 has a spring bias built into it or provided collaterally to it, once pressure is removed, this spring bias will cause the footrest 18 to return to its original orientation. Optionally, a two-way viscous friction means may be provided such that the user must "pull" the footrest 18 back to the initial position.

If the footrest 18 is divided into two parts then separate equivalents to hinge 25 and cylinder 19 may be employed.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. An exercise wheelchair comprising:

a frame with two rear wheels and at least one front wheel;

a seat with a front portion and a rear portion, the seat for receiving buttocks of a user;

a link having a first end pivotally connected to the frame to define a first fixed hinge, and a second end pivotally connected to the front portion of the seat to define a first floating hinge;

a backrest having a top portion and a bottom portion, the backrest for receiving a torso of the user, the backrest being pivotally connected to the frame at a section of the backrest located between the top portion and the bottom portion of the backrest to define a second fixed hinge, the bottom portion of the backrest being pivotally connected to the rear portion of the seat to define a second floating hinge, a reclining motion of the backrest causing a force to be applied to the seat through the second floating hinge and the seat to move forward, the first floating hinge moving along a circular arc with respect to the first fixed hinge upon a forward motion of the seat, the seat, backrest, first and second fixed hinges, and first and second floating hinges allowing the user to perform trunk extension exercises upon performing at least one of a reclining motion of the torso against the backrest and a pushing forward of the buttocks against the seat, the user being able to move about with the exercise wheelchair pre-and post-trunk extension exercises, the link allowing the seat to translate above the frame, in a forward and backwards direction while maintaining the seat in a substantially horizontal orientation while the backrest correspondingly reclines and returns to an upright orientation; and a resistance means attached to the frame at one end, and attached to at least one of the seat and the backrest at its other end, in order to provide a resistance during the trunk extension exercises.

2. The exercise wheelchair as claimed in claim 1 wherein the seat is positioned within the frame to place the combined center of gravity of the exercise wheelchair and the user forward of the contact point where the two main rear wheels rest on the ground to prevent the exercise wheelchair from tipping backwards.

3. The exercise wheelchair as claimed in claim 1 wherein the backrest comprises an extension below the second fixed hinge, the extension defining the bottom portion of the backrest.

4. The exercise wheelchair as claimed in claim 3 wherein the rear portion of the seat defines a notch for containing the second floating hinge and the extension comprised in the backrest is connected to the rear portion of the seat within said notch.

5. The exercise wheelchair as claimed in claim 1 wherein said resistance means is resilient.

6. The exercise wheelchair as claimed in claim 1 wherein said resistance means comprises damping means.

7. The exercise wheelchair as claimed in claim 6 wherein said damping means is adjustable, being provided with an adjustment means to control the degree of damping, thereby allowing a user to vary the amount of force required in order to recline the seat assembly.

8. The exercise wheelchair as claimed in claim 1 wherein the resistance means comprises one or more elastic bands that can be removably connected between the frame and the at least one of the seat and the backrest.

9. The exercise wheelchair as claimed in claim 1, further comprising a footrest pivotally connected to the frame forward and below the front portion of the seat, said footrest being coupled through a footrest coupling to the seat, the user pushing on the footrest causing a force to be applied to the seat and the seat to move forward, the moving forward of the seat causing the backrest to recline.

10. The exercise wheelchair as claimed in claim 9 further comprising resilient means to bias the footrest upwardly towards the seat section.

11. The exercise wheelchair as claimed in claim 10 wherein the footrest coupling constitutes the resilient means.

12. The exercise wheelchair as claimed in claim 9 wherein the footrest coupling comprises damping means.

13. The exercise wheelchair as claimed in claim 9 wherein the footrest is divided into two parts each part for receiving a foot of the user.

14. The exercise wheelchair as claimed in claim 9, further comprising a latch for locking the backrest to prevent rotation of the backrest about the second fixed hinge.

15. An exercise wheelchair comprising:

a) a frame having two main rear wheels and at least one front wheel;

b) a seating assembly comprising a seat section having front and rearward end portions and a back section, which sections are each respectively connected to the frame and to each other, the seat section for receiving buttocks of a user, the back section for receiving a torso of the user;

c) the back section having a lower end and an upper portion, the back section being connected at a point of the back section located between the lower end and the upper portion, to the frame through a fixed hinge joint about which the back section can rotate rearwardly permitting the back section to recline while supported by the frame, the lower end of the back section extending below the fixed hinge joint, the rearward end portion of the seat section being pivotally connected to the lower end of the back section through a rear pivoting connection to allow the back and seat sections to change their relative orientation to each other, while remaining connected, and d) a footrest pivotally connected to the frame forward and below the front portion of the seat section, the footrest for receiving feet of the user, the footrest being coupled through a footrest coupling to the seat section whereby, upon forward pivoting of the footrest, a force is transmitted through the footrest coupling from the footrest to the seat section to draw the seat section in a forward direction.

16. The exercise wheelchair as in claim 15 comprising resilient means to bias the footrest upwardly towards the seat section.

17. The exercise wheelchair as claimed in claim 16 wherein the footrest coupling is the resilient means.

* * * * *